US005655322A

United States Patent [19]

Howe

[11] Patent Number: 5,655,322

[45] Date of Patent: Aug. 12, 1997

[54] LOW WATTAGE LIGHT BULB MESSAGE MAKER

[76] Inventor: Tommy Alvin Howe, 33 Procter Place, Regina, Saskatchewan, Canada, S4S 4E9

[21] Appl. No.: 423,365

[22] Filed: Apr. 18, 1995

[30] Foreign Application Priority Data

Mar. 11, 1995 [CA] Canada ..... 2135004

[51] Int. Cl.[6] ..... G09F 13/28

[52] U.S. Cl. ..... 40/550; 362/252; 362/812

[58] Field of Search ..... 40/550, 551, 552, 40/581; 362/147, 249, 252, 812

[56] References Cited

U.S. PATENT DOCUMENTS

| | | | |
|---|---|---|---|
| 1,251,471 | 1/1918 | Brooks | 40/551 |
| 1,987,863 | 1/1935 | Murphy | 40/551 |
| 3,692,993 | 9/1972 | Robinson | 362/249 X |
| 4,970,812 | 11/1990 | Tanaka et al. | 40/550 X |
| 5,003,443 | 3/1991 | Sabala | 40/552 X |
| 5,390,093 | 2/1995 | Himeno et al. | 362/249 |
| 5,445,552 | 8/1995 | Hine | 362/249 X |
| 5,469,344 | 11/1995 | Kotsakis | 362/249 X |

FOREIGN PATENT DOCUMENTS

| | | | |
|---|---|---|---|
| 2164189 | 3/1986 | United Kingdom | 40/552 |

*Primary Examiner*—Brian K. Green

[57] ABSTRACT

An adjustable device for receiving and displaying decorative light emitting units to describe alpha-numeric characters, messages and designs in a variety of sizes and configurations using the same component parts. The device includes a plurality of identical elongate socket bar members attached in rows on two or more identical elongate hanger members. The socket bar members can be arranged in a variety of vertical spacings and horizontal offsettings on the hanger members. The assembled device allows the simultaneous lateral rotation of the socket bar members on the hanger members.

2 Claims, 4 Drawing Sheets

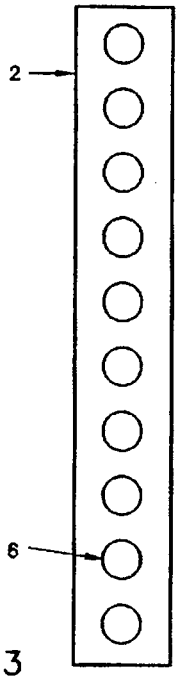
Fig. 3
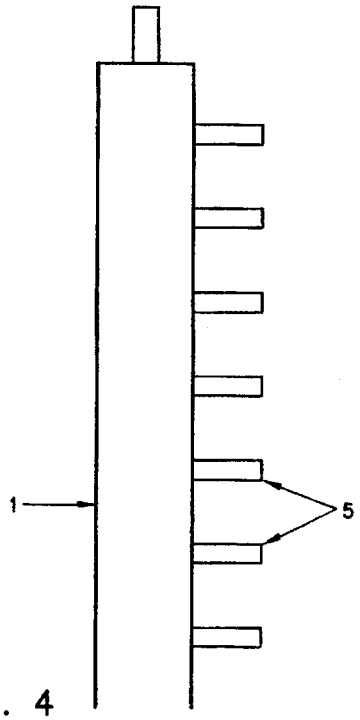
Fig. 4
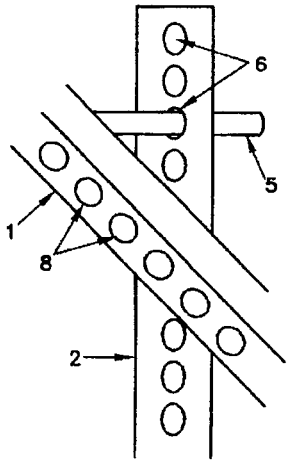
Fig. 5
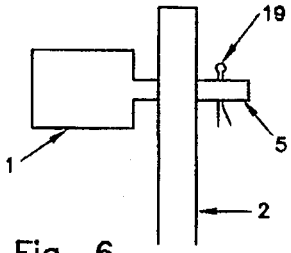
Fig. 6
Fig. 7
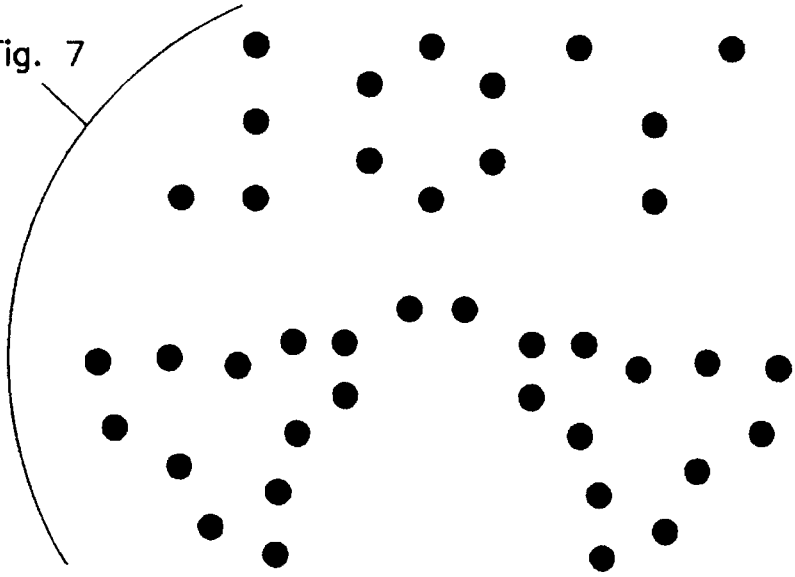

LOW WATTAGE LIGHT BULB MESSAGE MAKER

BACKGROUND OF THE INVENTION

FIELD OF THE INVENTION

Despite all the innovations in the commercial lighted message ideas and devices, none have penetrated the personal and festive season home message markets because they are: too fixed in form; too formal in appearance; too inflexible for creativity; too complex to assemble; too commercial to be cheerful; and too costly to afford.

I have spent more than 30 years of spare time experimenting with ideas and devices to resolve these problems. My first idea was a perforated flexible fibreglass panel about 8"×72" which accommodated the use of Christmas light bulb strings with the bulbs placed through the perforations to form letters (in accordance with an instructional key) and held in place by the sockets on the other side of the panel. I had a search made in 1962 and was advised by a patent attorney that it was likely too similar to Canadian Patent No. 348021 issued to Van Lawrence Vendope in about 1934 so, although I had some panels made and shown to some manufacturers and potential buyers, I decided not to incur any more expense in patent application, production or marketing of that particular device even though it had merit with its economy in the use of bulbs and sockets, lightness and versatility, but there were basic problems: (1) too much unused messy wiring on the back of the panel (between the sockets on the light strings) partially resolved by using add on sockets but this required rewiring the sockets for every message change; (2) bulb breakage caused by too much stress from the panel and sockets, the weight of which was carried by the bulbs. I continued my interest and experimentation with solutions to all the basic problems associated with fixed frame devices and panels and decided that the solution is to "free the message from the frame" with a device which enables each consumer to assemble his own personal holiday message and change it at will, as to configuration, size, length and content all at an affordable price.

This invention, which epitomizes the solution, is a versatile user-assembly message maker device comprising, not a fixed board, panel or device, but rather an unique "do it yourself kit" of only two basic parts,(i.e. socket bars and socket bar hangers) each relatively simple in isolation, but both newly, ingeniously and usefully designed, fitted and harmonized together to create a device that will be the first such device to enable every consumer to afford, choose, create, change, and display his own personal holiday message in any size, length and configuration using low wattage light bulbs.

Novel simplicity serving complex creativity, this invention is comprised of a new rigid, single row socket bar attached in horizontal rows on vertical hangers by attachment pins on the back face of each bar to attachment holes in, and extending the full length of the vertical hangers, all of which are ingeniously designed and harmonized in an assembly kit to provide virtually unlimited choice in dimension and configuration to accommodate messages of any content, length and style desired by the user. "Simplicity and economy in the medium to serve the creativity and personality of the message":

Some of the specific capabilities of this invention to resolve the difficulties and shortcomings of previous devices are as follows:

- Vertical spacing and positioning of the bars on the full length of the hangers for wide choice in letter size, line spacing, number of lines and design size, limited only by the height of hangers (which can be of any length);
- Horizontal positioning and offsetting of the bars on the hangers by means of attachment pins evenly spaced across the back face of the bars to accommodate either in line or offsetting the bars to provide the most efficient positioning of the bars and bulbs to form intelligible letters, words, messages and designs of any shape or size with the least number of bars and bulbs;
- Lateral rotation and movement of the bars on the hangers to accommodate jaunty message slant for the assembled message at any time by simply moving either end of the hangers to a forward or reverse position while the opposite end is secured, or by moving each vertically succeeding bar one attachment pin to the right or left of the bar above it;
- Horizontal extensions of socket bars permitting unlimited user choice and change in the length and content of the message;
- Lightness and portability for ease and convenience of carrying, installing, storing and marketing;
- Convenience in assembly (merely attach the bars to the hangers by selecting the proper two pins in each bar and insert in proper holes in each hanger and instal the bulbs in the bar sockets to make the chosen message) all of which can be performed indoors;
- Unlimited installation options made possible by the lightness and portability of the device (5 pounds or less for a 5 socket bar assembly of 7 watt bulbs forming a message e.g. approximately 7" high and 72" long) enables it to be easily carried, lifted, and affixed to, and supported by, any structure (wall, eaves trough, roof, chimney, trees, etc.); and
- The "built in" innovative capability of a self supporting display, the rigid hanger pipes performing the additional function of the support posts (for securing to the ground etc).

SUMMARY OF THE INVENTION:

This invention relates to a user assembled message maker apparatus for displaying low wattage light bulbs in arrangements that form user chosen letters, words, numbers, messages and designs, in flexible user chosen dimensions end configurations. Despite all the innovations in the commercial lighted message apparatus and devices, none have penetrated the personal and festive season message markets because they are: too fixed in form; too formal in appearance; too inflexible for creativity; too complex to assemble; too commercial to be cheerful; and too costly to afford. This invention, which epitomizes the solution to these problems and shortcomings, is a versatile user-assembly message maker device comprising, not a fixed board, panel or device, but rather a unique construction kit of only two basic parts, (i.e. socket bars and socket bar hangers) each relatively simple in isolation, but both newly, ingeniously and usefully designed, fitted and harmonized together to create a device that will be the first to enable every consumer to afford, choose, create, change, and display his/her own personal holiday message in any size, length and configuration using low wattage light bulbs.

BRIEF DESCRIPTION OF THE DRAWINGS

FIG. 3 is a front view of the hanger (pipe or strap)

FIG. 4 is a top view of socket bar with attachment pins

FIG. 5 is an angle view of a socket bar pin to hanger hole

FIG. 6 is a side view of a socket bar pin secured in hanger

FIG. 7 is a front view of lighted message and design at night

DESCRIPTION OF THE PREFERRED EMBODIMENTS.

Figure 8:
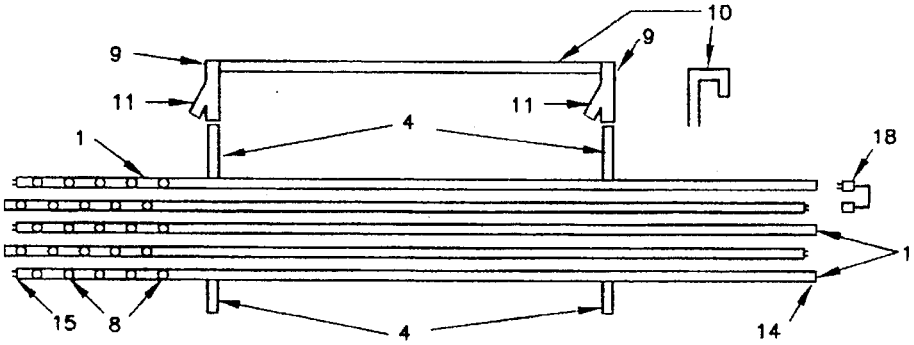
FIG. 8 is a front view of socket bars attached to hangers in the optional offset and reversed bar formation
Figure 14:
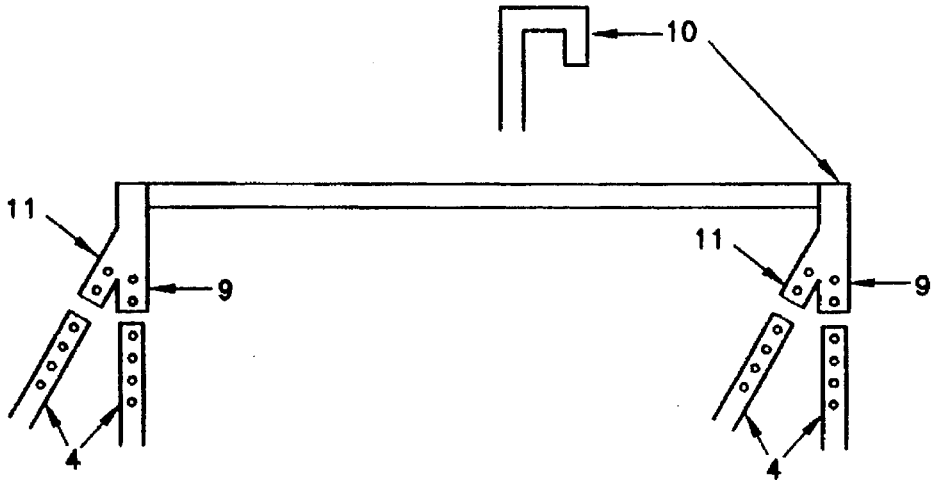
FIG. 14 is a front view of an eaves trough adapter (as shown in FIG. 8) with both vertical and slant accommodation and a side view of the top hook part of the adapter not seen in the front view
Figure 15:
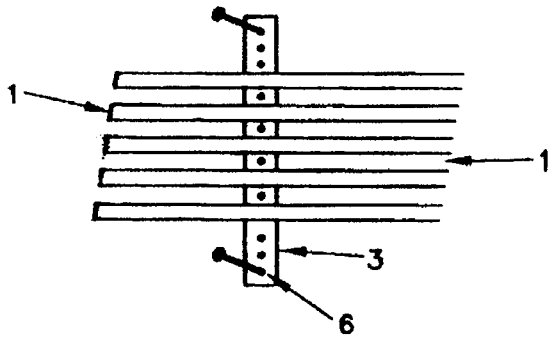
FIG. 15 is a sectional front view of a 5 bar assembly with short hangers to be attached to a wall with nails or screws
Figure 16:
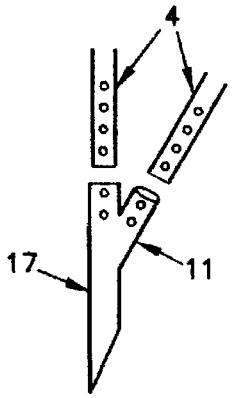
FIG. 16 is a front view of ground adapter for hanger pipe with both vertical and slant accommodation

The Details of the Drawings illustrate a socket bar 1 adapted for attachment to a hanger 2 (being a strap 3 or a pipe 4) by means of attachment pins 5 protruding from and equally spaced across the center line of the back face of the bar 1 into attachment holes 6 evenly spaced on the center line for the length of the hanger 2 and accommodating optional selection in vertical and horizontal spacing and offsetting and lateral rotation of the bars 1 on the hangers 2. The socket bars 1 are assembled on the hangers 2 in the configurations and numbers chosen by the user to accommodate the installation of low wattage light bulbs 7 in socket shaped cavities 8 to form intelligible messages and designs (FIG. 1A, FIG. 1B FIG. 2 and FIG. 7). The assembled apparatus (FIG. 1A, FIG. 1B, FIG. 8 and FIG. 11) is adaptable to be fastened to walls (FIG. 15) and similar structures, to eaves troughs (FIG. 8) by an eaves trough adapter 9 (FIG. 8 and FIG. 14) designed with hooks 10 for securing adapter to eaves trough, and a self supporting display accommodated by ground adapters 17 (FIG. 16) to secure the bottom of the hanger pipes 4 thereby accommodating the message slant option for the assembled displays either by rotating the bottom of the hangers 2 when the top is secured (FIG. 1A and FIG. 1B) or by selecting the slant option 11 on the adapters (FIG. 14 and FIG. 16). The slant option is also achieved by moving each socket bar 1 on a line of display one attachment pin 5 to the left or right of the bar above beginning at the top.

Figure 1A:
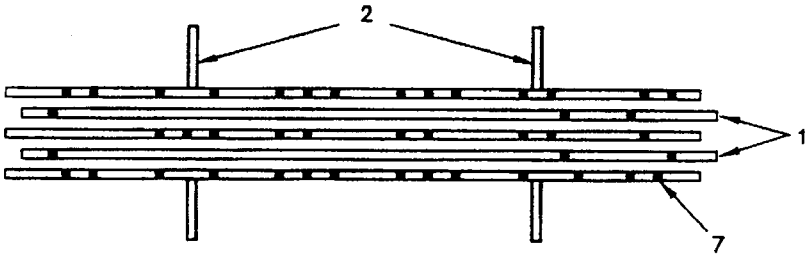
FIG. 1A is a front view of an assembled display shown in the vertical message mode
Figure 1B:
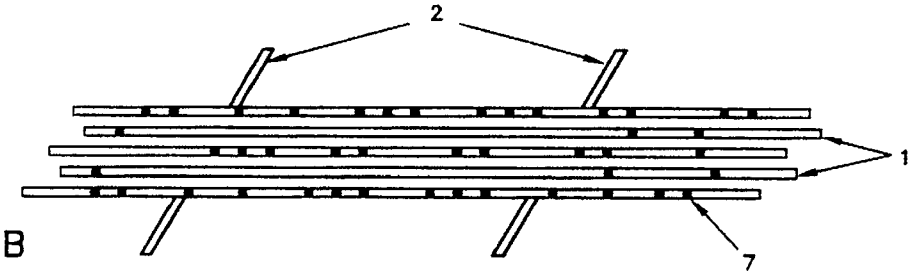
FIG. 1B is a front view of an assembled display shown in the slanted message mode
Figure 2:
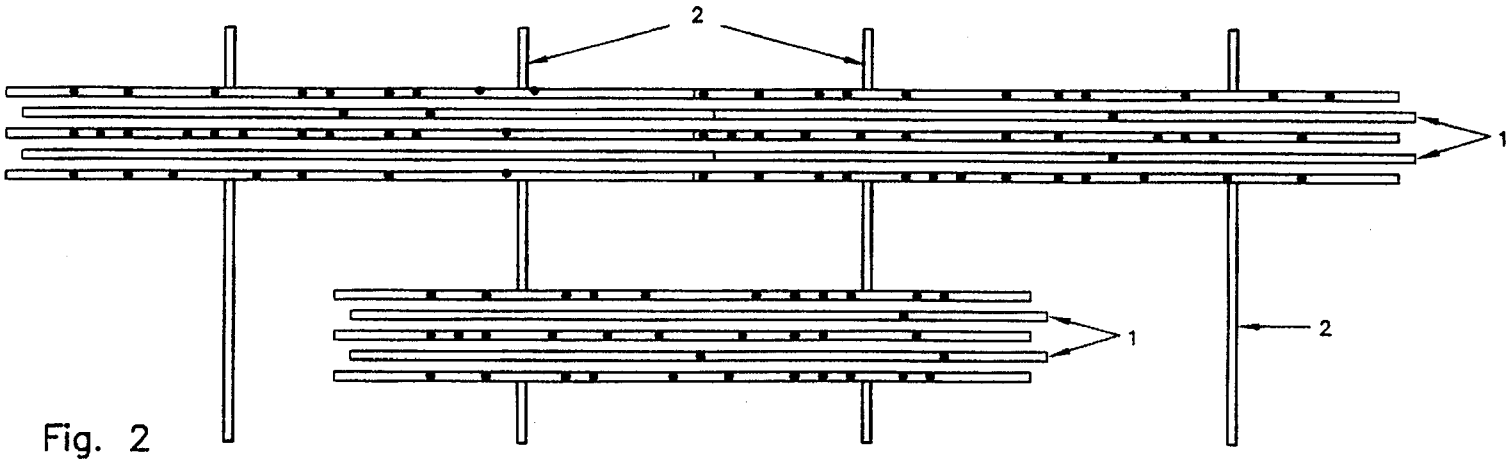
FIG. 2 is a front view of an assembled message horizontally and vertically extended (2 sets of bars and 2 lines)
Figure 9:
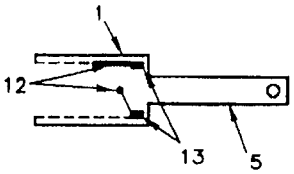
FIG. 9 is a cross section of the bar at a socket cavity
Figure 10:
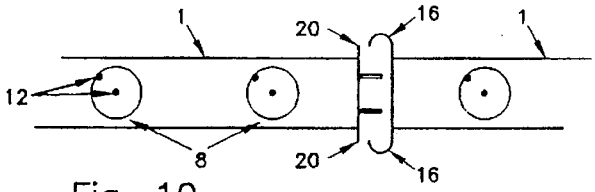
FIG. 10 is a front view of two bars in horizontal extension
Figure 11:
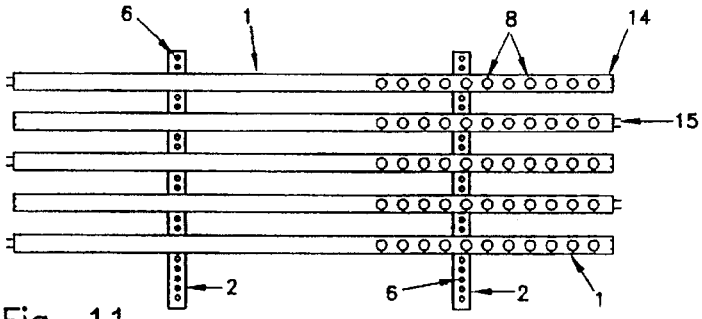
FIG. 11 is a front view of bars assembled on hangers with in line vertical spacing and without horizontal offset
Figure 12:
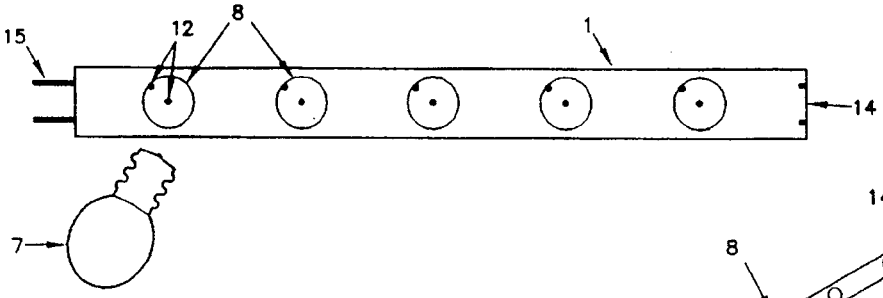
FIG. 12 is a front view of socket cavities on socket bar
Figure 13:
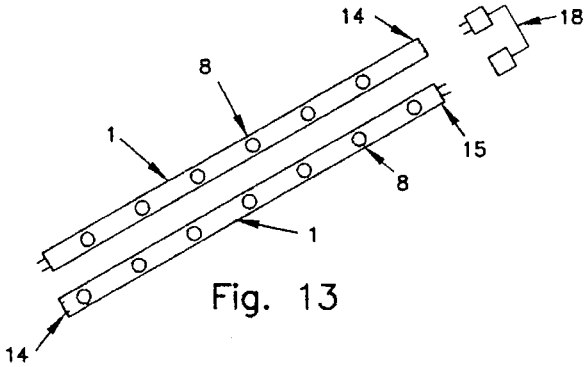
FIG. 13 is a front view of two bars in offset configuration

The socket bar cavities 8 (FIG. 9, FIG. 10 and FIG. 12) are sized and threaded to accommodate low wattage bulbs 7 which when inserted in the cavities 8 make contact with electrical contact points 12 connected to electrical conducting wires 13 which extend from a female electrical plug 14 to a male electrical plug 15 at opposite ends of the bar, all of which is encompassed within and part of the socket bar 1 which is made or moulded from plastic compositions commonly used in the sockets on low wattage Christmas light strings. The extension grabbers 16 and extension holders 20 at opposite ends of the socket bar 1 (FIG. 10) hold two extended bars together when required to accommodate longer displays such as that shown in FIG. 2. FIG. 2 also illustrates the versatility of horizontally extended displays in accommodating vertically extended displays in a variety of configurations with the same hangers.

Figure 17:
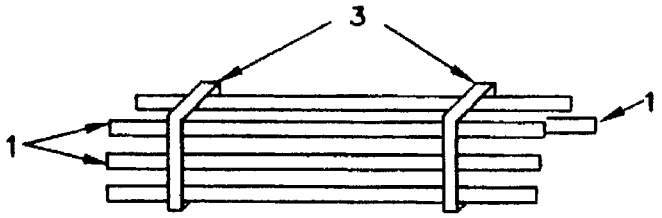
FIG. 17 is an assembled display wrapped in its own hanger straps

The socket bar 1 and the spacings of both the socket shaped cavities 8 on its front face and the attachment pins 5 on its back face are designed to accommodate bar reversal and bar offsetting (FIG. 8, FIG. 13, FIG. 1A and FIG. 1B) providing versatility in the configurations of the bars 1 on the hangers 2 and shorter electrical connecting cords 18 at each end of the assembled display (FIG. 1A, FIG. 1B, FIG. 2 and FIG. 7). The socket bar pin 5 is shown in FIG. 5 and FIG. 6 inserted in a hole 6 in a hanger 2 and held in place by a cotter key 19 (which is inserted in a perforation or slot on the socket bar pin 5). The hangers 2 are either hanger straps 3 made of strong flexible elastic material such as that used for tie down straps, or hanger pipes 4 made of strong, light, rigid plastics or metals. Both have attachment holes 6 extending throughout their length accommodating the socket bar pins 5 and permitting lateral rotation of the socket bar 1 on the hangers 2. The attachment holes 6 also serve as holes for nails or screws used in affixing the hangers 2 to a wall etc. and as holes for bolts or pins to affix the hanger pipes 4 to ground adapters 17 and eaves trough adapters 9. The hangers 2 are of a width less than the distance between the two socket bar pins 5 on either side of the pin to which the hanger 2 is attached to allow the lateral rotation required for message slant. The hanger straps 3 are designed to have the elasticity and strength to provide the tautness required for stabilizing the socket bars 1 attached thereto. Their flexibility enables them to be used to wrap the assembled display in a neat package without dissassembly (FIG. 17).

The socket bars 1, hangers 2 and electrical extension cords 18 are designed and colored to be minimumly visible on the assembled display especially when the display is lit at night resulting in total prominence to the message as illustrated in FIG. 7.

FIG. 7 also illustrates the capability of the invention to give expression to artistic designs as well as messages.

The hangers (two for each set of vertically assembled bars) are either flexible straps or rigid pipes uniquely designed with the precision and qualities that are required for the simplicity and accuracy essential to the creative functions of the device. The hanger straps and hanger pipes are interchangeble, having common accommodation and fitting specifications for the socket bars.

Both types have socket bar pin attachment holes spaced vertically and evenly apart on the center line of, and throughout the length of, the hanger and at the same vertical distance apart (e.g. about one centimeter for bars with 5 or 7 watt sockets) to accommodate maximum vertical spacing options between socket bars for optimum versatility in message and design dimensions and configuration. Both types can accommodate the bar pins at any horizontal location on the bars to provide the most effective stability of the assembled display having regard to installation factors. Both accommodate the lateral rotation of the socket bars on the hangers by adjusting the vertical angle of the hangers to make a forward or reverse slant of the total assembled message in one motion. Both are of narrow width (less than the distance between 3 bar pins) to permit the message slant rotation of the bars on the hangers, and dark colors to become invisible when the display is lit. Both are variable in length to meet the needs of both the vertical dimension of the total display and the installation.

The pin holes on the hangers also serve as nail or screw holes for attaching both top and bottom ends of the hangers to walls etc. which accommodates the slant option without slant adapters. Ground adapters, eaves trough hooks with message slant adapters, chimney belts, and other optional attachment accessories facilitate other installation locations (e.g. eaves troughs, chimneys, cables etc).

The hanger straps are made of strong flexible materials with an elastic quality (e.g. rubber, nylon or plastic composition similar to some common tie down straps) with width and thickness to meet the support needs of the socket bars (light though they are) and to accommodate the evenly spaced holes throughout their length for the pins on the socket bars. The elasticity of the straps ensures the tautness necessary to maintain the horizontal and lateral stability of the bars. Straps are particularily convenient and adaptable for most message assemblys, large and small, because they are flexible and adaptable to most installation locations that provide opportunity for securing the hanger straps at both their top and bottom ends (e.g. to wall or from eave to ground) and can be of any length to meet those needs. The hanger straps provide another innovative advantage i.e. they enable the whole assembled display (socket bars, light bulbs and hanger straps) to be taken down (without dissasembly) and rolled up together "in its own hanger straps" into one neat package for carrying, storage and ready for use again without reassembly.

The rigid hangers (pipes or rods) together with slant adapters accommodate installations that need more top to bottom stability where only one end can be secured firmly, such as eaves troughs, leaving the other end unattached or with only lightly secured attachment. The slant option on the eaves trough adapter (which has double hooks for securing the adapter to eaves troughs) hold the hanger pipe in the slant position without securing it at the bottom. Similarily, the slanting of the self supporting ground display is accommodated by a slant option on the ground adapters into which the hanger pipes (ground posts) are inserted. These pipes or rods are made from materials (metals or plastics) that provide enough strength and rigidity to not only support and maintain the assembled socket bars in a fixed position but also to serve the added function of ground posts for self supporting displays giving the device a unique and useful "built in independance" from any other support. These rigid hanger pipes also serve as convenient extended handles for carrying and lifting the assembled device into place (e.g. to secure on an eaves trough or wall without a ladder). In lawn displays (the hanger pipes doubling as posts) the message slanting can be provided by adjustable ground adapters for the posts but also by another method of slanting which is common to all displays i.e. by moving each succeeding socket bar on the assembled message one additional attachment to the left or right of the bar above it working from the second top bar down.

The socket bar is a novel invention, a rigid bulb accommodation bar for low wattage light bulbs, being a moulded bar (of plastics etc.) in the form of a single, horizontal row of equally spaced sockets, all on the same face and plane, built into and forming a rigid bar of sockets. The bar is a narrow dimensioned rectangular moulded device made from plastics etc. that have the qualities of rigidity, durability and strength, encompassing within the moulded rigid bar electrical conducting wires extending the length of the bar, male and female plugs with extension grabbers at opposite ends of the bar, bulb contact points (attached to the conducting wires) and threaded bulb attachment cavities to accommodate low wattage light bulbs (screw in or snap in) and spaced at even intervals across the front face of the bar, and a row of attachment pins protruding from and spaced evenly on the center line across the back face of the bar. The socket cavities may vary in spacing among bars for different wattage bulbs but generally the recommended spacing between the center points of the socket cavities will be approximately two socket cavity diameters.

Each attachment pin on the back face of the bar has a diameter approximately ⅕ of the spacing between pins and is designed to fit the hanger holes. The pins are located on the back face of the bar directly opposite the center point of each socket cavity and also at the halfway point between such center points (essential to meet precision in bar offsetting). Each pin has a notch or small perforation near the end of it to accommodate a small cotter key etc. to secure the pin firmly in a hole in the hanger.

The bar pins and socket cavities are positioned on the bar so that their relative positions and functions are not affected by reversing the bar (end to end and top to bottom). This permits alternating female and male connectors at the ends of each succeeding row of bars to accommodate shorter electrical cords connecting one row of bars to another at each end of the display.

The number of sockets used on one circuit must comply with C.S.A. standards and similar standards in other jurisdictions (e.g. the wattage limit for 5 and 7 watt sockets in Canada is 1250 and therefore permits 178 active 7 watt sockets and 250—5 watt sockets on one circuit). This allows the connection of a number of bars together on the same circuit depending on the number of sockets provided and used across the length of the bar, which may vary in length to accommodate the requirements for rigidity, C.S.A. standards, use and ease of handling. The socket bar is new and unique in design and function and essential to accommodate the utility, flexibility and economy of the message maker apparatus. The message is formed on the assembled socket bars by placing bulbs in the selected sockets positioned to form the letters in the message with the greatest degree of intelligibility and precision and the greatest economy in numbers of bars and bulbs used. Versatility and creativity in message making demands that the apparatus enable the user to make any and all letters with uniformity and precision at any horizontal point. This invention has accommodated this essential. It is necessary to understand the importance of precision and uniformity in bulb positioning (also uniform color) in order to make neat and intelligible messages. Each letter demands a precise position for each bulb used in its formation relative to the other bulbs in the letter.

The positioning and number of bulb used to make a particular letter may vary from one display to another depending on the number of horizontal rows of sockets used for the message, the spacing of the sockets on the bar, the vertical spacing between the bars, all to meet the choice of the user as to size, shape and precision of the letters and the length and configuration of the message to be displayed.

With the vast amount of experimenting I have carried out, I first discovered that very intellible letters (all 26 plus 10 digits) can be formed with nine horizontal rows of sockets (e.g. 78 sockets per 72" bar) at any point on the bar with minimal vertical spacing between bars, and with every second bar horizontally offset by ½ the horizontal distance between socket centres.

However further experimenting, revealed that by using only 5 bars spaced further apart vertically (about one bar height) with only 40 sockets per 72" bar, and offsetting every second bar at ½ the new horizontal distance between the socket centres, I was able to achieve the same quality of letter precision and intelligibility (with minor exceptions) also at any point on the bar, at a saving of almost half the number of bars and half the number of sockets in each bar. Although the versatility of the apparatus to accommodate 9 bars (or any number of bars) is inherent in the invention the 5 bar arrangement per line of message is the most economic for messages, easiest to assemble, and handle.

As illustrated above, bar offsetting capability and the pins which permit it, are important factors in achieving precision with economy, and also versatility for special artistic 'designs in lights' which experimentation has proven can be accommodated very effectively and economically. Although the apparatus may have some application for larger light bulbs and other kinds of light emitting units its design and function is more suited to use low wattage sockets and bulbs that are commonly used in outdoor and indoor Christmas light strings (with color choices). Fixed commercial signs and electronic score boards etc. generally use twice the number of bulbs to make letters and messages and lack the other advantages of this invention, especially its unique features required to accommodate and serve the residential market.

The user can choose and change the size, length, and configuration of his own created message, including the number of lines, the color and 'saucy slant'. The portability, flexibility and lightness of the total device enables the user to adapt it to virtually any location (e.g. walls, eaves troughs, balconies, porches, chimneys, eaves, trees and the self supporting display anywhere) and even to put the smaller displays "out for the night and in for the day".

To ensure precision, economy and ease of assembling the bulbs in the proper sockets I have designed an instructional key (not included herewith) to accompany the apparatus on the market, showing the precise arrangements of bulbs for intelligible letters, words and numerals at maximum economy in bar and bulb useage and adaptable to all sizes of bars and bulbs and all vertical spacings between the bars, using only 5 rows of socket bars (offsetting every second bar by one attachment pin) and using the same mininum number of bulbs regardless of letter height or size (e.g. only 69 bulbs to make the message "HAPPY HOLIDAY").

The light weight of the apparatus accommodates the use of slender dark colored hangers (straps or pipes), which, together with dark colored socket bars and connecting electrical cords, will not be seen as part of the display after dark, leaving the lighted bulbs to "free the message from the frame" which is what we set out to do in perfecting this invention to serve the needs of this market of cheer making displays.

These novel, useful, ingenious features and capabilities to serve the untapped residential holiday message display market are not available from other devices or inventions.

This invention gives every user unlimited freedom to design holiday messages which match the needs, creativity, personality and economy of the user.

It will open up a totally new market of fun and cheer in creating and viewing residential decoration displays on festive, sporting, holiday (and perhaps even political) occasions!

The user assembly, add on features, simplicity of manufacture and assembly, (only two basic parts, socket bar and hanger), innovatively designed as a "simple do it yourself kit" gives this invention a great market and manufacturing potential.

I claim:

1. An adjustable device for receiving and displaying decorative light emitting units to describe alpha-numeric characters, messages and designs in a variety of sizes and configurations comprising:

(a) a plurality of elongate identical and functionally reversible socket bar members, each containing a row of equally spaced identical sockets along its length;

(b) each of said sockets adapted for receiving one of said light emitting units;

(c) each of said plurality of socket bar members including a plug connector at one end and a receptor connector at the other end to accommodate horizontal connection of said socket bar members to each other;

(d) each of said plurality of socket bar members including means of attachment comprising two or more identical cylindrical pins protruding out from and perpendicular to a back face of each of said socket bar members;

(e) two or more identical elongate hanger members, each with a column of equally spaced perforations throughout its length, one of said perforations located at each end of each of said hanger members, each of said perforations adapted to receive and secure therein one of said pins on one of said socket bar members in a manner permitting lateral rotation of said one socket bar member on said hanger member about an axis defined by said one pin in said perforation, said pins and perforations together providing capability for securing at least five said socket bar members in parallel to each other on said hanger members at a plurality of vertical spacings and horizontal offsettings of said socket bar members in relation to each other and permitting said socket bar members to be simultaneously rotated laterally on said hanger members.

2. The device as described in claim 1 wherein each of the said sockets on said socket bar members is adapted for electrical connection with one of said light emitting units and each of said sockets is electrically connected by electrical conductors within and extending the full length of each of said socket bar members to said plug connector and said receptor connector, said plug connector and receptor connector being adapted to accommodate direct electrical connection between said socket bar members and to a power source.

* * * * *

UNITED STATES PATENT AND TRADEMARK OFFICE

CERTIFICATE OF CORRECTION

PATENT NO. : 5,655,322
DATED : Aug. 12, 1997
INVENTOR(S) : Tommy Alvin Howe

It is certified that error appears in the above-identified patent and that said Letters Patent is hereby corrected as shown below:

On the title page item [30] Foreign Application Priority Data "Mar. 11, 1995" Should read -- Nov. 3, 1994--.

Signed and Sealed this

Third Day of February, 1998

*Attest:*

Bruce Lehman

BRUCE LEHMAN

*Attesting Officer*

*Commissioner of Patents and Trademarks*